United States Patent [19]

Jeffers et al.

[11] Patent Number: 4,959,894

[45] Date of Patent: Oct. 2, 1990

[54] DISPOSABLE SEMI-DURABLE NONWOVEN FABRIC AND RELATED METHOD OF MANUFACTURE

[75] Inventors: Cecil W. Jeffers, Norwood; Richard Sewcyk, Stoughton, both of Mass.

[73] Assignee: International Paper Company, Purchase, N.Y.

[21] Appl. No.: 383,843

[22] Filed: Jul. 21, 1989

Related U.S. Application Data

[62] Division of Ser. No. 221,816, Jul. 20, 1988.

[51] Int. Cl.[5] ..... D04H 01/46

[52] U.S. Cl. ..... 28/104; 19/161.1

[58] Field of Search ..... 28/104, 106; 19/161.1

[56] References Cited

U.S. PATENT DOCUMENTS

| | | | |
|---|---|---|---|
| 2,862,251 | 12/1958 | Kalwaites | 19/161 |
| 3,081,514 | 3/1963 | Griswold | 28/78 |
| 3,081,515 | 3/1963 | Griswold et al. | 28/78 |
| 3,458,905 | 8/1969 | Dodson, Jr. et al. | 19/161 |
| 3,485,706 | 12/1969 | Evans | 428/134 |
| 3,493,462 | 2/1970 | Bunting, Jr. et al. | 428/134 |
| 3,498,874 | 3/1970 | Evans et al. | 428/280 |
| 3,508,308 | 4/1970 | Bunting, Jr. et al. | 28/72.2 |
| 3,679,535 | 7/1972 | Kalwaites | 428/280 |
| 3,679,536 | 7/1972 | Kalwaites | 428/280 |
| 3,681,184 | 8/1972 | Kalwaites | 428/280 |
| 3,747,161 | 7/1973 | Kalwaites | 19/161.1 |
| 3,917,785 | 11/1975 | Kalwaites | 28/104 |
| 4,024,612 | 5/1977 | Contractor et al. | 28/72.2 F |
| 4,144,370 | 3/1979 | Boulton | 428/233 |
| 4,297,404 | 10/1981 | Nguyen | 428/85 |
| 4,379,799 | 4/1983 | Holmes et al. | 428/131 |
| 4,465,726 | 8/1984 | Holmes et al. | 428/131 |
| 4,612,226 | 9/1986 | Kennette et al. | 428/134 |
| 4,665,597 | 5/1987 | Suzuki | 28/104 |
| 4,693,922 | 9/1987 | Buyofsky et al. | 428/134 |

FOREIGN PATENT DOCUMENTS

| | | | |
|---|---|---|---|
| 5266772 | 6/1977 | Japan | 28/104 |

*Primary Examiner*—Werner H. Schroeder
*Assistant Examiner*—John J. Calvert
*Attorney, Agent, or Firm*—Francis J. Clark

[57] ABSTRACT

A disposable semi-durable wipe is fabricated by fluid entanglement of a composite web including carded and randomized layers fabricated of a blend of at least 10% rayon and polyester fibers. Two sided entanglement of the web enhances interstitial binding of web fibers to provide a durable fabaric in which void areas are well defined for improved conformability and absorbency. The fabric has a basis weight in the range of 45–70 gsy, uniform cohesive MD and CD grab tensile strengths of approximately 25 lbs/inch, and an MD/CD fiber ratio in the range of 2.5:1 to 1.5:1. An adhesive binder is applied to the fabric to provide an abrasion resistance feature.

5 Claims, 6 Drawing Sheets

DISPOSABLE SEMI-DURABLE NONWOVEN FABRIC AND RELATED METHOD OF MANUFACTURE

This is a divisional of copending application Ser. No. 221,816, filed on Jul. 20, 1988.

DESCRIPTION

1. Field of Invention

This invention generally relates to nonwoven wiping cloths having industrial, hospital and household applications, and more particularly, fluid entangled semi-durable wipes which are absorbent, abrasion resistant, and conform to wiping surfaces.

2. Background Art

Nonwoven wipes fabricated by fluid entangling processes are well known in the prior art. In conventional entangling processes, webs of nonwoven fibers are treated with high pressure fluids while supported on apertured patterning screens. Typically, the patterning screen is provided on a drum or continuous planar conveyor which traverses pressurized fluid jets to entangle the web into cohesive ordered fiber groups and configurations corresponding to void areas in the patterning pending to void areas in the patterning screen. Entanglement is effected by action of the fluid jets which cause fibers in the web to migrate to void areas in the screen, entangle and intertwine.

Prior art hydroentangling processes for producing patterned nonwoven fabrics which employ high pressure columnar jet streams are represented by U.S. Pat. Nos. 3,485,706 and 3,498,874, respectively, to Evans and Evans et al., and U.S. Pat. No. 4,379,799 to Holmes et al.

The art has fabricated nonwoven wiping cloths by conventional entangling processes employing isotropic webs of blended rayon and polyester fibers which have application for use in disposable wipes. Rayon and polyester respectively impart absorbency and tensile strength to the wipe. Variations in the percentage blend of these fibers provide wipes for diversé food service, medical and industrial applications. Abrasion resistance in such wipes is enhanced by application of adhesive binders to the entangled fabric. U.S. Pat. No. 4,612,226 to Kennette et al. discloses a representative prior art wipe.

In the selection of specifications for wipes, the art has recognized that there is an inverse correlation between absorbency and strength in nonwoven wipes. Fabric voids provide surface areas for absorption of fluids, however, increased void area diminishes the tensile strength of the fabric. The present invention is directed to a process and fabrics which are absorbent and have greater tensile strength than achieved in the prior art.

Accordingly, it is a broad object of the invention to provide an improved disposable semi-durable wipe having absorption and tensile strength features which advance the art.

A more specific object of the invention is to provide an improved hydroentangling process which yields a durable, nonwoven wipe which is characterized by conformability to wiping surfaces, supple drape, dimensional stability, and abrasion resistance.

Another object of the invention is to provide a hydroentangling process which produces a rayon/polyester blend nonwoven wipe having characteristics improved over the prior art.

DISCLOSURE OF THE INVENTION

In the present invention, these purposes, as well as others which will be apparent, are achieved generally by providing a disposable semi-durable wipe fabricated by fluid entanglement of a composite web including carded and randomized layers of blended rayon and polyester fibers. The composite web includes top and bottom sides which are respectively supported and fluid entangled on formacious entangling members. Two sided entanglement of the web enhances interstitial binding of web fibers to provide a durable fabric in which void areas are well defined for improved conformability and absorbency.

A preferred fabric of the invention is fabricated of a composite web including 70% 1.5 inch denier staple hemicellular free rayon and 30% non-optically brightened polyester. The fabric includes a lattice structure of spaced approximately parallel machine direction ("MD") oriented fibrous bands, and spaced cross-direction ("CD") oriented fibrous bands which intersect the MD bands. The CD bands each have a generally sinusoidal configuration and are arranged in an array in which each band is 180° out of phase with respect to adjourning bands in the array. Void areas defined by the areas of nonintersection of the MD and CD bands occupy approximately 36% of the entangled fabric to provide for enhanced fabric absorbency. The fabric has a basis weight in the range of 45–70 grams per square yard (gsy), uniform cohesive MD and CD grab tensile strengths of approximately 25 lbs/inch, and MD/CD fiber ratio in the range of 1.5:1 to 2.5:1.

Further advantage is obtained by saturating the fabric with an adhesive resin binder to enhance fabric abrasion resistance. The preferred fabric is coated with an acrylic binder including a wetting agent and a pigment fixative.

In accordance with the invention method, a composite web is provided which includes carded and randomized layers fabricated of a blend of at least 10% rayon with polyester fibers. Top and bottom sides of the web are respectively supported on formacious entangling members including void areas of approximately 39%, and traversed by first and second stage spaced entangling fluid jets. The fluid jets impact the web at pressures within the range of 400 to 2000 psi, and are preferably ramped, to impart energy to the web of approximately 0.7 to 1.2 hp-hr/lb of fabric.

Following entanglement, fluid is extracted from the fabric and an adhesive binder formulation, such as an acrylic resin polymer, may be applied to the fabric by conventional padding apparatus. The acrylic preferably has a low glass transition temperature (Tg) to provide a soft fabric finish.

It is a feature of the invention to employ entangling members which have a symmetrical pattern of void areas which correspond to preferred fabric patterns. Improved MD and CD tensile strengths are obtained by a two sided entanglement process which coacts with entangling member patterns. The preferred patterns include a 36×29 flat plain weave screen made of a plastic monofilament wire, and a 22×24 drum plain weave bronze wire screen which are, respectively, employed in the first and second entangling stages.

Other objects, features and advantages of the present invention will be apparent when the detailed description of the preferred embodiments of the invention are considered in conjunction with the drawings which should be construed in an illustrative and not limiting sense as follows:

BEST MODE OF CARRYING OUT THE INVENTION

Figure 1:
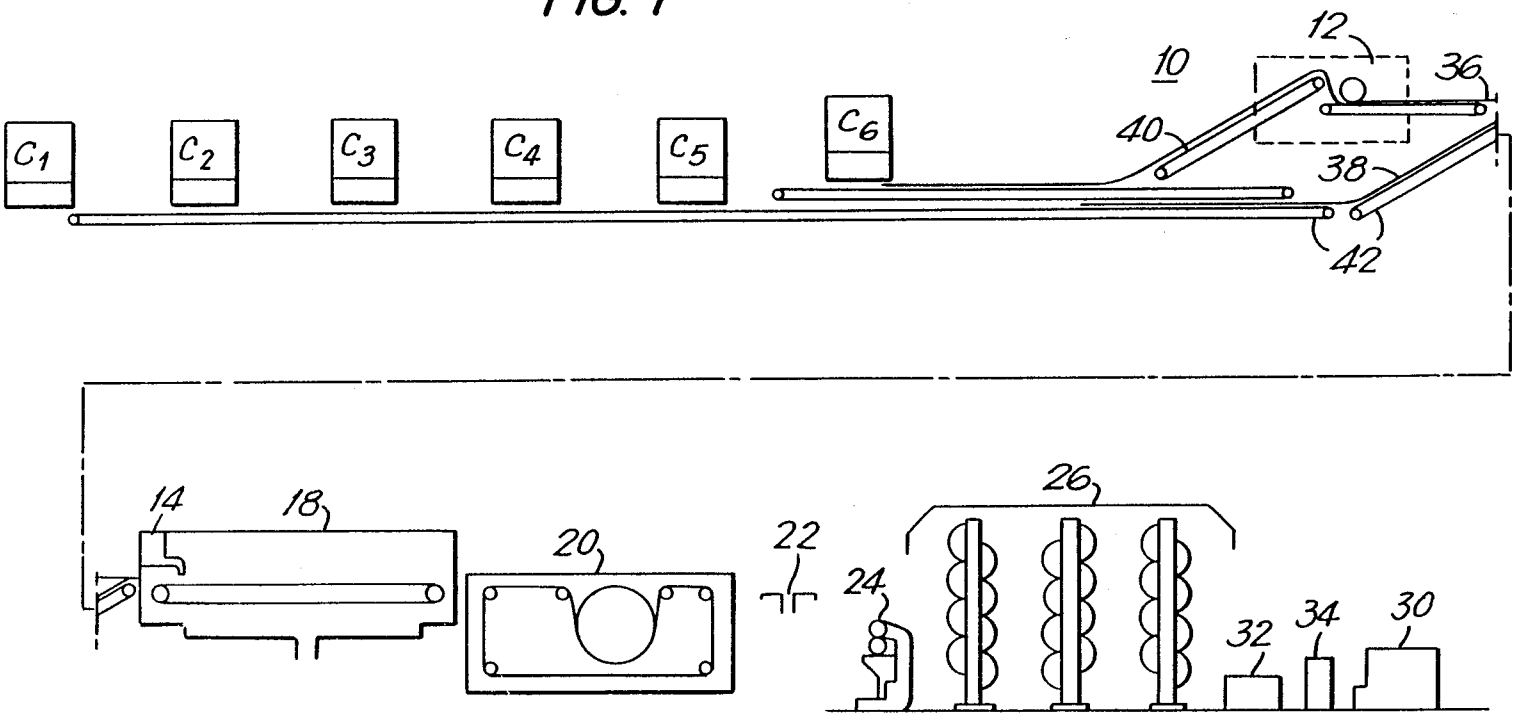
FIG. 1 is a schematic view of a production line including high speed cards, hydroentangling modules, a vacuum dewatering roll, a padder, dry cans, and other apparatus for the production of nonwoven wipes in accordance with the invention.

With reference to the drawings, FIG. 1 shows a fabric production line 10 in accordance with the invention for production of nonwoven wipe fabrics including, a series of conventional carding apparatus C1–C6, a random web former 12, and pre-wet wire station 14 which feed a composite web 16 to hydroentangling modules 18, 20. At the output end of the entangling module 20, the line includes a deionized water rinse and vacuum slot extractor station 22, a conventional padder 24, and dry cans 26 which provide a finished nonwoven fabric 28 for stock rolling on a winder 30. An antistatic roll 32 and weight determination gauge 34 are also employed on the line.

Modules 18, 20 effect two sided entanglement of the composite web 16 which includes randomized and carded layers 36, 38 to provide a fabric with well defined interstitial fiber entanglement and structure. Particular advantage is obtained in the invention when the composite web 16 is anistropic and includes a blend of at least 10% rayon and polyester staple fibers.

The preferred composite web 16 is fabricated of a blend of AVTEX SN 6533 1.5 denier 1.5 inch staple hemicellular free rayon manufactured by Avtex Fibers Inc., Front Royal, Va., and a non-optically brightened polyester offered by Celanese Corporation, Charlotte, N.C., under product designation T-304. The AVTEX rayon and Celanese polyester fibers are processed in an open blender to provide web layers 36, 38 each having a 70/30 per cent rayon/polyester content, and weight of approximately 29 gsy.

Figure 4:
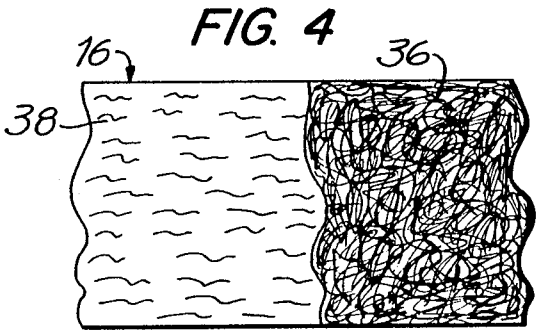
FIG. 4 is a plan view, partly in section, of a composite web employed in the invention including lower carded and upper randomized layers.
Figure 3:
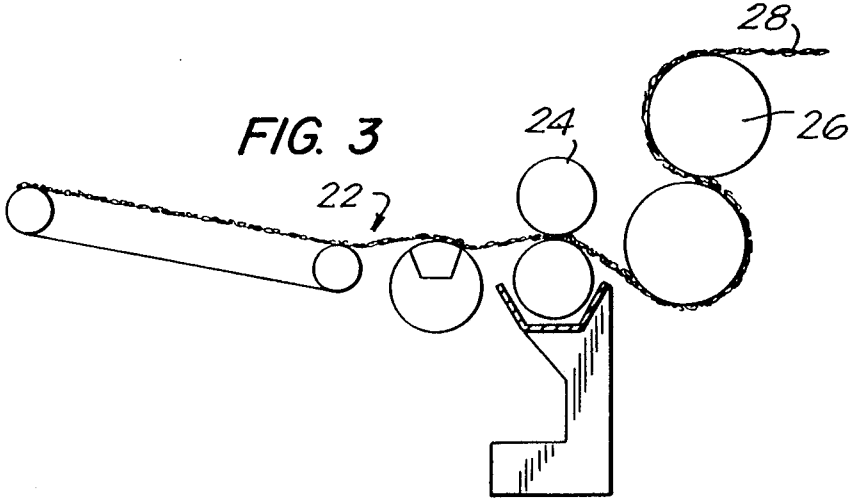
FIG. 3 is a schematic illustration of the vacuum dewatering roll and padder employed in the process of the invention.

Advantage in the invention is obtained by combining features of both carded and random web layers in the composite web 16 for use in hydroentangling modules 18, 20. As described hereinafter, layers 36, 38 coact to produce a fabric 28 which has improved uniformity and superior MD/CD strength characteristics. The composite web 16 and photomicrographs of a preferred fabric are respectively illustrated in FIGS. 4 and 7A and B.

Method and Mechanism of the Entangling Modules

As illustrated in FIG. 1, following carding the upper web layer 36 is advanced on conveyor 40 to the random web former 12 to form an upper isotropic layer. Conveyors 42, which by-pass the web former 12, advance carded layer 38 to the pre-wet station 14 for combination with randomized layer 36 and feeding to the entanglement modules 18, 20.

Figure 2:
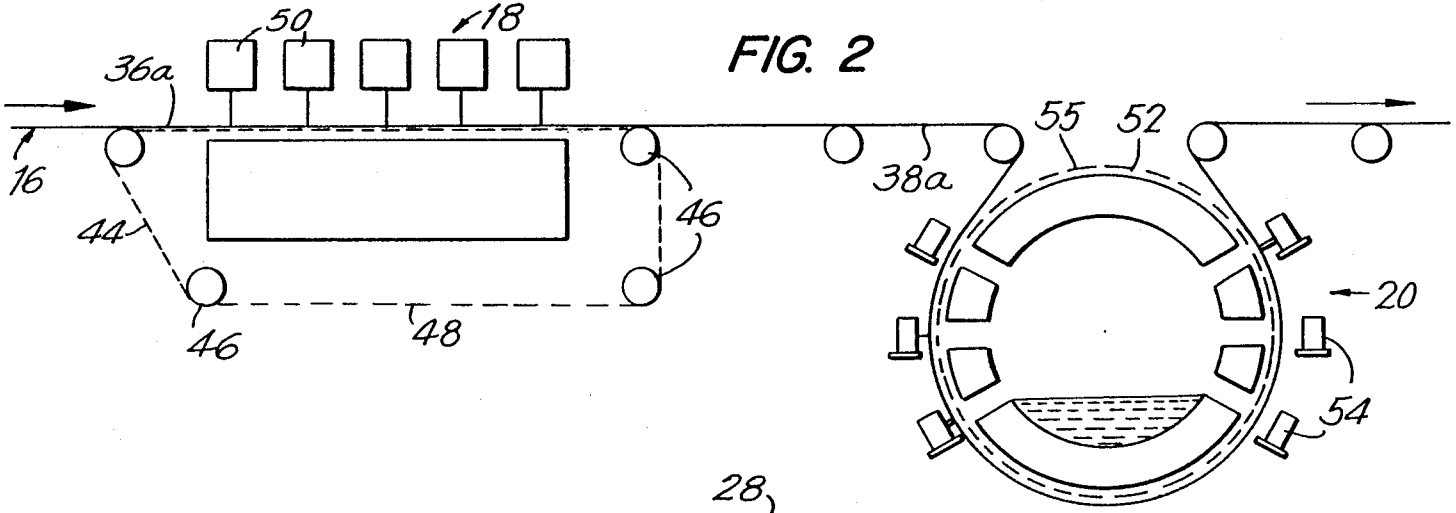
FIG. 2 is a schematic illustration of the hydroentangling modules employed in the process of the invention.

FIG. 2 illustrates the entanglement modules 18, 20 which are utilized in a two staged process to hydroentangle, in succession, top and bottom sides **36*a*, 38*a* of the composite web 16**.

Module 18 includes a first entangling member 44 supported on an endless conveyor means which includes rollers 46 and drive means (not shown) for rotation of the rollers. Preferred line speeds for the conveyor are in the range of 50 to 600 ft/min.

Figure 5A:
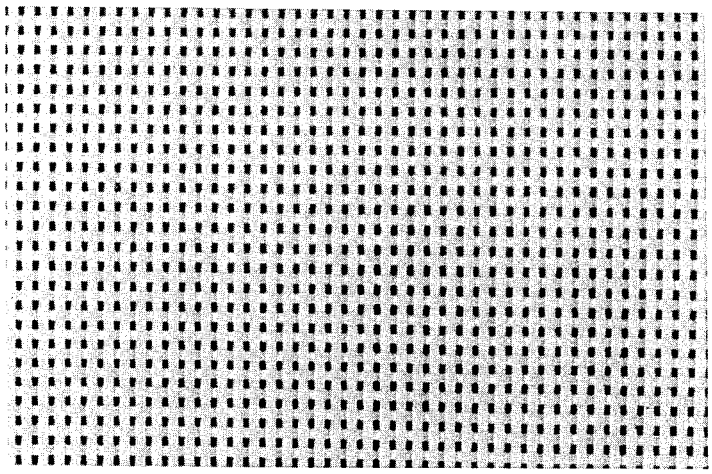
FIGS. 5A and B are photographs at 3.5×magnification of 36×29 and 22×24 mesh plain weave forming members, respectively, employed in the flat and drum entangling modules of FIG. 2.

The entangling member 44, which preferably has a planar configuration, includes a symmetrical pattern of void areas 48 which are fluid pervious. A preferred entangling member 44, shown in FIG. 5A, is a 36×29 mesh weave having a 23.7% void area, fabricated of polyester warp and shute round wire. Entangling member 44 is a tight seamless weave which is not subject to angular displacement or snag. Specifications for the screen, which is manufactured by Appleton Wire Incorporated, P.O. Box 508 Kirby, Portland, Tenn. 37148, are set forth in Table I.

TABLE I

| | Forming Screen Specifications | |
|---|---|---|
| Property | 36 × 29 flat | 22 × 24 drum |
| Mesh | 36 × 29 ± 1 | 22 × 24 ± 1 |
| Warp wire (stainless steel or bronze) | .0157 polyester round | .025 ± .002 face × .013 ± .002 height |
| Shute wire (stainless steel or bronze) | .0157 polyester round | .018 ± .002 |
| Weave type | plain | plain |
| Open area | 23.7% | 25.6% ± 1.5 |
| Plane difference | | .008 ± .002 |
| Snag | none ± light | |
| Weave tightness (slay) | no angular displacement | |
| Edges | ½" reinforcement | butted |
| Seam | invisible/endless | invisible/endless |

Module 18 also includes an arrangement of para spaced manifolds 50 oriented in a cross-direction ("CD") relative to movement of the composite web 16. The manifolds which are spaced approximately 10 inches apart and positioned approximately 1 inch above the first entangling member 44, each include a plurality of closely aligned and spaced jet nozzles (not shown) designed to impact the web with fluid pressures in the range of 400 to 2000 psi. Manifold pressures are preferably ramped in the machine direction so that increased fluid impinges the web as its lattice structure and coherence develop. Effective first stage entanglement in the invention is effected by energy output to the composite web 16 of at least 0.1 hp-hr/lb and preferably in the range of 0.1–0.5 hp-hr/lb.

Figure 5B:
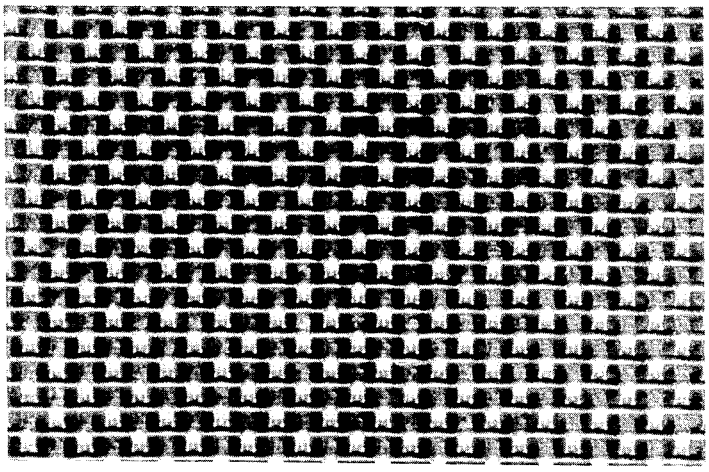

Following the first stage entanglement, the composite web 16 is advanced to module 20 which entangles the bottom side 38*a* of the web. Module 20 includes a second entangling member, shown in FIG. 5B, which has a cylindrical configuration 52, and 26% symmetrical pattern of void areas 55. Entangling member 52 is a 22×24 plain weave, manufactured by Appleton Wire Incorporated, fabricated of stainless steel or bronze warp and round shute wire having the specification set forth in Table I.

Module 20 functions in the same manner as the planar module 18. Manifolds 54 which carry jet nozzles are stacked in close proximity spaced from the entangling member 52 to impact the web with ramped essentially columnar jet sprays. The manifolds are preferably spaced 8 inches apart, 1 inch from the entangling member, and impact the web with fluid pressures in the range of 400 to 2000 psi. Effective second stage entanglement is effected by energy output to the composite web 16 of at least 0.4 hp-hr/lb and preferably in the range of 0.4–1.2 hp-hr/lb.

Following entanglement the web 16 is rinsed with deionized water and passed through the vacuum slot extractor 22 to remove excess water and prepare the web for saturated application of an aqueous resin binder in the padder station 24.

Binder compositions for use in the invention are designed to enhance fabric tensile strength, abrasion resistance and resistance to staining. Acrylic latex binders have been found particularly suitable for use in wipe fabrics because of their stain resistance capabilities. A preferred acrylic composition employed in the invention is set forth in Table II. It will be recognized that the amount of binder applied to the fabric varies with fiber composition, weight and intended end use of the fabric. Typically, the acrylic binder saturates the fabric and comprises 1 to 5% of the finished resin treated fabric weight. The binder is cured in a conventional manner in stacks of dry cans 26 operated at steam pressures within the range of 80 to 200 psi. See FIG. 1.

Nonwoven fabrics produced by the dual entangling process of the invention are characterized by close knit fiber interstitial binding which enhances the fabric porosity and tensile strength. Preferred fabrics of the invention have a basis weight in the range of 45 to 70 gsy, and MD and CD grab tensile strengths of approximately 15 lbs/inch and 10 lbs/inch. Advantage is obtained through use of the composite web 16 which includes randomized and carded layers 36, 38 to yield fabrics which are uniform in fiber distribution and have MD/CD ratios in the range of 1.5:1 to 2.5:1.

TABLE II

| Component | % Active (solid) | pph dry (parts/hundred) | % dry | % wet | Mix weight (lbs) |
|---|---|---|---|---|---|
| Water | | | | 93.789 | 390.63 |
| Acrylic resin polymer* (enhances fabric durability) | 45 | 100 | 97.6 | 6.070 | 25.28 |
| Ethoxylated Alcohol (nonionic wetting agent) | 50 | .75 | 0.7 | 0.041 | 0.17 |
| Polyethylene glycol (softening agent) | 38 | .75 | 0.7 | 0.054 | 0.22 |
| Dioctyl Sodium Succinate (wetting agent) | 60 | 1 | 1.0 | 0.046 | 0.19 |

*A preferred acrylic is marketed under the product designation National Starch 25-4484 by National Starch and Chemical Corporation, 10 Sinderne Avenue, Bridgewater, New Jersey 08807. National Starch acrylic has a low glass transition temperature (Tg) and is also solvent resistant.

Figure 6:
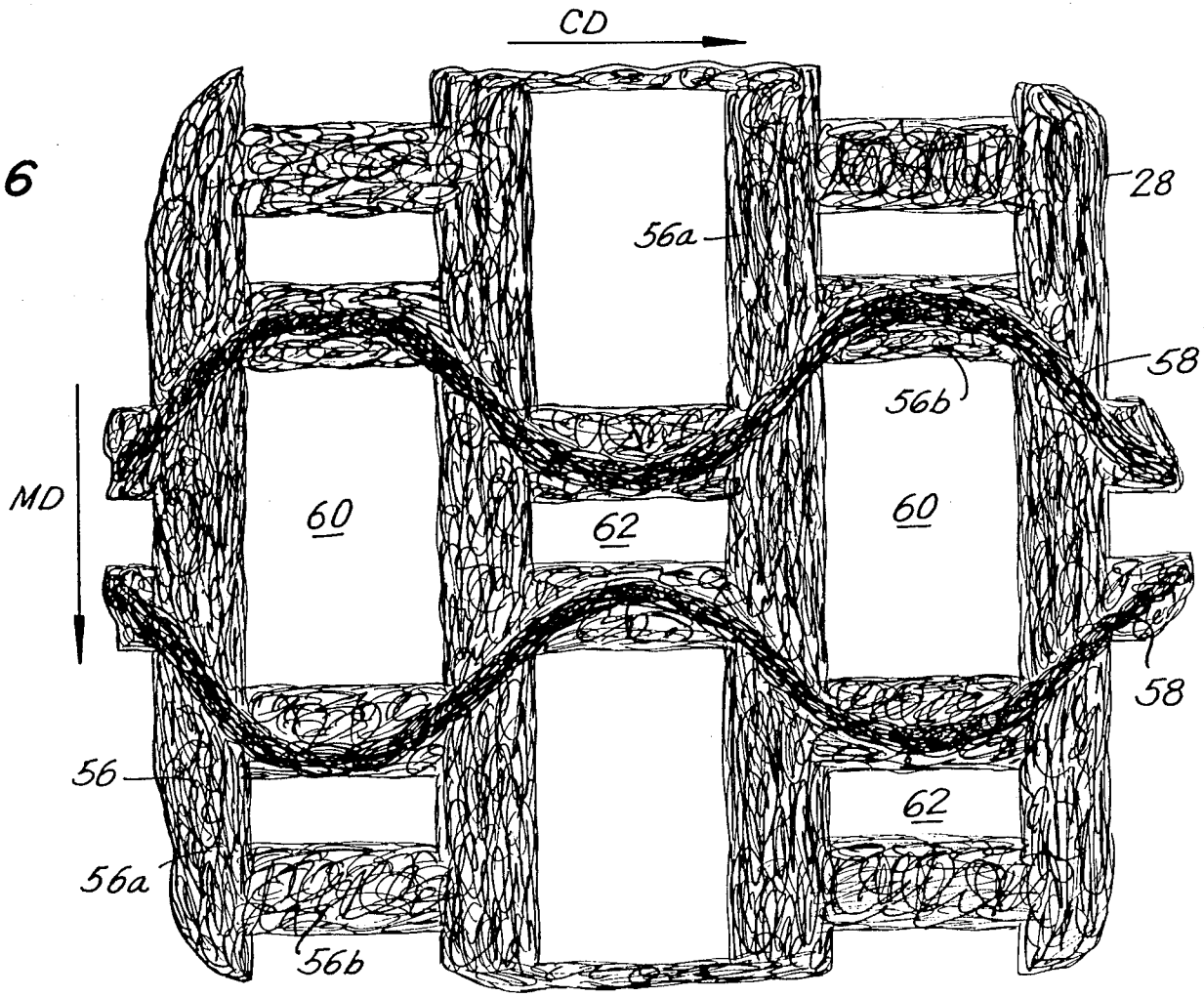
FIG. 6 is a schematic illustration of a nonwoven fabric produced on the production line employing the forming members of FIGS. 5A and B.

FIG. 6 schematically illustrates a preferred fabric structure of the invention which is obtained employing the entangling members 44, 52 of FIGS. 5A, B. Fluid entangled fibers are arranged in a symmetrical array including a lattice structure of spaced approximately parallel MD and generally sinusoidal CD bands 56, 58, respectively located in carded and randomized web layers 38, 36. The MD and CD bands 56, 58 intersect and entangle to define a cohesive structure.

MD bands 56 include parallel segments 56*a*, and cross-segments 56*b* which extend in the cross-direction between adjacent MD bands alternately spaced closer and farther apart in the machine direction. CD bands 58 are arranged in an array in which each band is 180° degrees out-of-phase with respect to adjourning bands. Out-of-phase CD bands have alternating sinusoidal peak and trough segments which overlie in alignment with the parallel and cross-segments 56*a,b* of the MD bands. Tensile strength in the fabric is enhanced by the arrangement of MD and CD bands in the carded and randomized web layers 38, 36 which are interstitially entangled in substantially all regions of interface. See FIGS. 6, 7A, B.

Figure 8C:
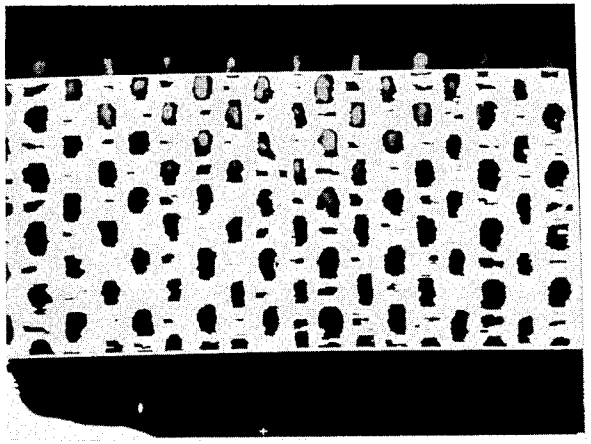
FIG. 8C is an inverse light detection Photograph at 7.5×magnification of the nonwoven wipe illustrated in FIG. 8A.
Figure 8B:
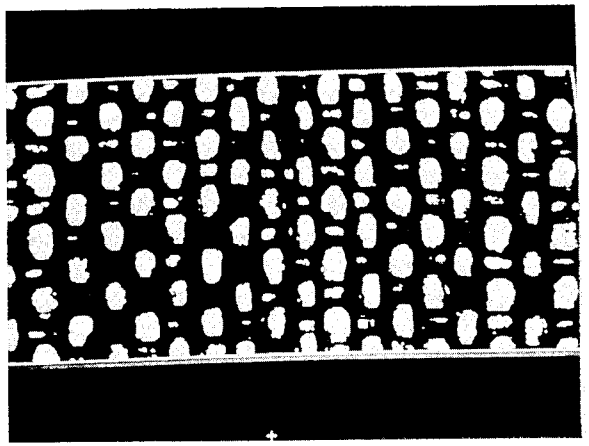
FIGS. 8A and B are micro and open space light detect photographs at 7.5×magnification of the nonwoven wipe of FIGS. 7A and B showing void fiber pattern areas in the fabric.
Figure 8A:
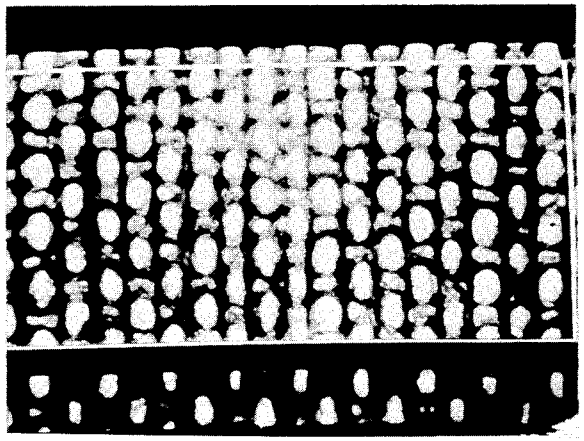

MD and CD bands 56, 58 further define a symmetrical array of porous void areas 60, 62 which are disposed between aligned troughs and peaks of the CD bands and have generally rectangular configurations. FIGS. 8B and C illustrate this void pattern in open and inverse light detection photographs at 7.5×magnification of a preferred fabric. White and dark regions in the photographs respectively correspond to void areas 60, 62, and fibrous bands 56, 58 in the fabric.

Figure 7B:
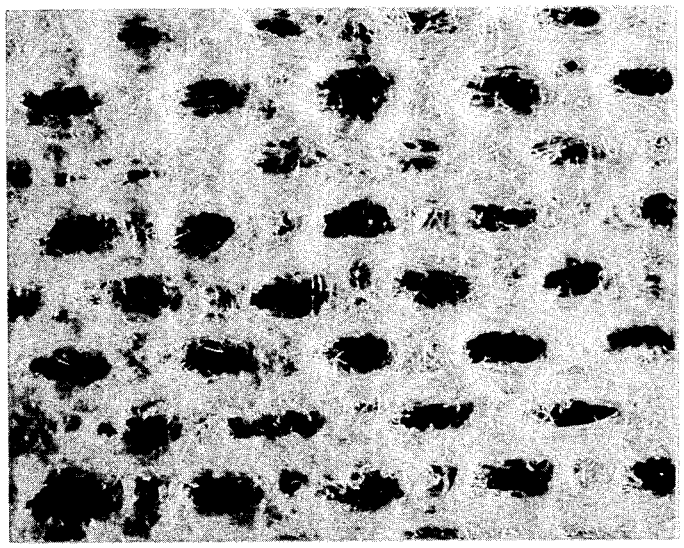
FIGS. 7A and B are photographs at 2×and 11×magnification of nonwoven wipes produced as disclosed in Example 1.
Figure 7A:
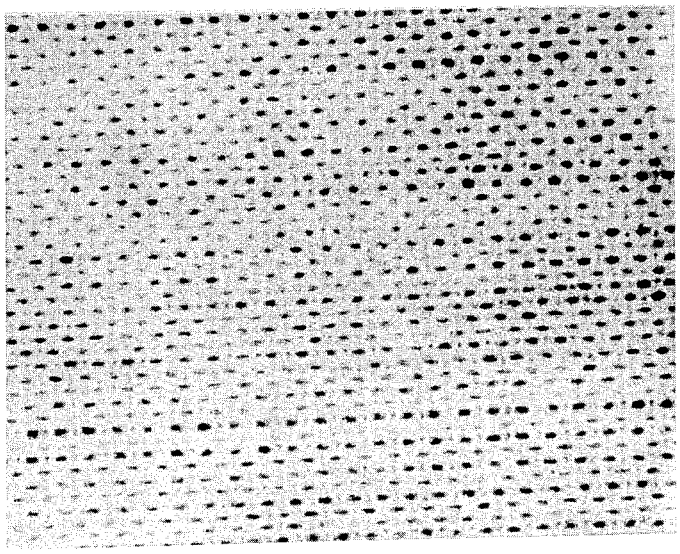

Examples 1–3 and corresponding FIGS. 7A, B describe and illustrate representative fabrics produced by the method of the invention employing the entangling members 44, 52 and production line 10 of FIG. 1.

EXAMPLE I

A fabric designed for food service industry applications were produced employing a 50/50 carded and random web composed of 30% Celanese T304 1.5 inch, 1.45 denier, 5.5 gram/denier non-optically brightened polyester, and 70% AVTEX 6533 1.5 inch denier, 3.5 gram/denier hemicellular free rayon. The AVTEX rayon and Celanese polyester fibers were processed in an open blender to provide web layers 36, 38 having a 70/30 per cent rayon/polyester content and weight of approximately 29 gsy. Production speed on the line was ramped from 75 to reach 125 ft/min (fpm) to impart energy to the web at the rate 1 hp-hr/lb to produce a base fabric weighing 58 gsy ±4 gsy.

Table III sets forth energy specifications for production of the 58 gsy fabric of Example I at an average line speed of 100 fpm. Energy imparted to the web by each manifold in the entanglement modules is calculated by summing energy output for each manifold in accordance with the following equation:

$$E = \frac{14.2\ CD^2}{Wt\ S}\ \frac{p^{1.5}}{Ww}\ N\ Wj$$

where
$E$ = hp-hr/lb
$C$ = jet orifice discharge coefficient (dimensionless)
$P$ = manifold pressures (psi)
$N$ = jet density (jets/inch)
$S$ = line speed (ft/minute)
$Wt$ = basis weight at winder (grams/yd$^2$)
$Wj$ = web width at each jet
$Ww$ = web width at winder The discharge coefficient (C) is dependent on jet pressure and orifice size. Coefficients for a jet having an orifice diameter of 0.005 inches and water temperature of 85° F. are as follows:

| Pressure (psi) | C | Pressure | C |
|---|---|---|---|
| 300 | .77 | 900 | .66 |
| 400 | .74 | 1000 | .74 |
| 500 | .71 | 1100 | .63 |
| 600 | .70 | 1200 | .62 |
| 700 | .68 | 1300 | .62 |
| 800 | .67 | 1400 | .62 |
| | | 1500 | .62 |

TABLE III

| Hydroentangling Energy at 100 FPM | | | | | |
|---|---|---|---|---|---|
| Manifold No. | Pressure psi | Flow gal/min | Energy hp-hr/lb | Total hp-hr/lb | Energy distribution % |
| | | Flatscreen - Module 18 | | | |
| 1 | 400 | 68.895 | 0.023 | 0.023 | |
| 2 | 600 | 79.817 | 0.040 | 0.063 | |
| 3 | 700 | 83.749 | 0.049 | 0.112 | |
| 4 | 900 | 92.170 | 0.069 | 0.182 | |
| 5 | 1200 | 101.591 | 0.102 | 0.284 | |
| 6 | 1300 | 104.061 | 0.113 | 0.397 | |
| | | Screen Total | | 0.397 | 39.5% |
| | | Drum Screen - Module 20 | | | |
| 7 | 600 | 79.817 | 0.040 | 0.040 | |
| 8 | 700 | 83.749 | 0.049 | 0.089 | |
| 9 | 800 | 88.215 | 0.059 | 0.148 | |
| 10 | 1100 | 98.810 | 0.091 | 0.239 | |
| 11 | 1200 | 101.591 | 0.102 | 0.341 | |
| 12 | 1400 | 107.989 | 0.127 | 0.468 | |
| 13 | 1500 | 111.779 | 0.140 | 0.608 | |
| | | Screen Total | | 0.608 | 60.5% |
| | | TOTAL ENERGY | | 1.005 hp-hr/lb | |

Following entanglement, the base fabric was passed through the slot extractor station 22 for in line saturated padding with 2.8% acrylic binder mix having the composition set forth in Table II. Padder roll pressure settings were calibrated to effect an application rate of 1.6 gpm for a binder add-on of 2±1 gsy to yield a fabric having a weight of 60 gsy±3 gsy. The binder was then cured in dry cans 26 to provide a finished fabric for converting. Tables IV and V respectively set forth dry can settings and physical characteristics of the fabrics of produced in Examples 1–3.

TABLE IV

| Dry Can Settings | | | | | | |
|---|---|---|---|---|---|---|
| | Can Number: | | | | | |
| Speed - FPM | 1 | 2 | 3 | 4 | 5–10 | 10–20 |
| 75 | 20 | 80 | 80 | 90 | 40 | 90 |
| 100 | 25 | 80 | 80 | 90 | 100 | 105 |
| 125 | 30 | 80 | 80 | 95 | 110 | 115 |

EXAMPLE II–III

Nonwoven fabrics having application for use as automobile and hospital service wipes were produced employing the composite web and process conditions of Example I. Desired fabric characteristics were obtained in these applications through use of binder formulations set forth in Tables VI - A and B.

The automobile service wipe is produced employing the binder formulation of Example I modified to include increased concentrations of ethoxylated alcohol, polyethlyne glycol, and dioctyl sodium. Crock resistant color pigments were also added to the binder for aesthetic effect to provide a uniform streak free wiping fabric that is solvent resistant. See Table VI - A.

The binder formulation for the hospital service wipe includes a antimicrobial agent of the type offered under the brand designation ULTRA-FRESH by Bio Dor Products Ltd., 1150 Fairfield Avenue, Bridgeport, Conn. 06604. The antimicrobial agent provides a fabric which is resistant to the growth of bacteria and fungi, and consequent rotting and mildewing of the fabric. Effective results are obtained when the antimicrobial is added to the formulation in the order of 1–10 parts per hundred on binder solids in the formulation. See Table VI - B.

TABLE V

| Fabric Properties | | | |
|---|---|---|---|
| Property: | Example I | Example II | Example III |
| Basis Weight (gsy) | | | |
| With Binder | 58–62 | 58–62 | 58–62 |
| Without Binder | 56–60 | 56–60 | 56–60 |
| Tensile (lbs/inch) | | | |
| MD | 15–30 | 15–30 | 15–30 |
| CD | 10–20 | 10–20 | 10–20 |
| Elongation (%) | | | |
| MD | 50–65 | 50–70 | 50–65 |
| CD | 125–145 | 125–145 | 125–145 |
| Thickness (mils) | 28–32 | 28–36 | 26–34 |
| Mullen Burst (psi) | 34–40 | 34–45 | 32–42 |
| Trapezoidal Tear (lbs/inch) | 7–10.5 | 8–12 | 7–10.5 |
| Water Absorbency Sink Time/Second | 2.5–5.0 | 2.5–5.0 | 2.5–5.0 |
| Capacity (g fabric/g water) | 8–12 | 8–12 | 8–12 |

TABLE VI

| A -- Automobile Service Wipe | | | | | |
|---|---|---|---|---|---|
| Component | % Active (solid) | pph dry | % dry | % wet | Mix weight (lbs) |
| Water | | | | 93.411 | 389.06 |
| Acrylic resin polymer | 45 | 100 | 84.7 | 5.273 | 21.96 |
| Ethoxylated Alcohol | 50 | 2 | 1.7 | 0.095 | 0.40 |
| Polyethylene glycol | 38 | 2 | 1.7 | 0.125 | 0.52 |

TABLE VI-continued

| Component | A – Automobile Service Wipe % Active (solid) | pph dry | % dry | % wet | Mix weight (lbs) |
|---|---|---|---|---|---|
| Dioctyl Sodium Succinate | 60 | 2 | 1.7 | 0.079 | 0.33 |
| Pigment Yellow | 28 | 10 | 8.5 | 0.847 | 3.53 |
| Pigment Orange | 28 | 2 | 1.7 | 0.169 | 0.71 |

TABLE VI

| Component | B – Hospital Service Wipe % Active (solid) | pph dry | % dry | % wet | Mix weight (lbs) |
|---|---|---|---|---|---|
| Water | | | | 93.817 | 390.75 |
| Acrylic resin polymer* | 49 | 100 | 87.7 | 5.013 | 20.88 |
| Ethoxylated Alcohol | 50 | .75 | 0.7 | 0.037 | 0.15 |
| Polyethylene glycol | 38 | .75 | 0.7 | 0.048 | 0.20 |
| Dioctyl Sodium Succinate | 60 | 2.5 | 2.2 | 0.102 | 0.43 |
| Antimicrobial (ULTRA FRESH) | 25 | 10 | 8.8 | 0.982 | 4.09 |

It will be recognized by those skilled in the art that the process of the invention has wide application for the production of a diversity of patterned nonwoven fabrics with characteristics determined by the design and specifications of the entangling members 18, 20, fiber blend of the composite web 16, as well as adhesive binder selection.

Thus, in the examples, food service and hospital wipes are differentiated by the chemical systems employed in the adhesive binder. The bacteria free hospital wipe includes an antimicrobial agent, while the food service wipe has larger binder concentrations of dioctyl sodium succinate for improved washability and soil release characteristics. All wipes are color pigmented and preferably include a pigment fixative, such as ethoxylated alcohol, which imparts solvent resistance to the binder formulation.

Numerous modifications are possible in light of the above disclosure. For example, the preferred process of the invention employs water as the entangling medium. Other media and chemical systems may be employed in the entangling process. Similarly, although selected entangling members 44, 52 are illustrated in the drawings, it will be recognized that other configurations are within the scope of the invention.

Therefore, although the invention has been described with reference to certain preferred embodiments, it will be appreciated that other nonwoven fabrics and processes may be devised, which are nevertheless within the scope and spirit of the invention as defined in the claims appended hereto.

We claim:

1. A method of producing a disposable and semi-durable nonwoven fabric which comprises the steps of:

(a) supporting a composite web of staple fibers on a first entangling member, said composite web including top and bottom sides formed by respective top and bottom web component layers, one of which is a carded web component layer and the other of which is a randomized web component layer, said first entangling member having a symmetrical pattern of fluid pervious void areas;

(b) traversing the top side of said composite web with spaced columnar fluid jets at pressures within the range of 400 to 2000 psi for sufficient duration to effect a first stage randomization and entanglement of said web fibers and form nonwoven fabric having a structure determined by said first entangling member;

(c) supporting said composite web on a second entangling member having a symmetrical pattern of fluid pervious void areas, said symmetrical pattern of said second entangling member being different from that of said first entangling member; and (d) traversing the bottom side of said composite web with spaced columnar fluid jets at pressures within the range of 400 to 2000 psi for sufficient duration to effect a second stage randomization and entanglement of the nonwoven fabric, the fabric having a resulting structure determined by the coaction of the first and second randomization and entanglement on said first and second entangling members.

2. A method for producing a disposable and semi-durable nonwoven fabric which comprises the steps of:

(a) supporting a composite web of staple fibers on a first entangling member, said composite web including top and bottom sides formed by respective top and bottom web component layers, one of which is a carded web component layer and the other of which is a randomized web component layer, said first entangling member having a symmetrical pattern of fluid pervious void area;

(b) traversing the top side of said composite web with spaced columnar fluid jets at pressures within the range of 400 to 2000 psi for sufficient duration to effect a first stage randomization and entanglement of said web fibers and form nonwoven fabric having a structure determined by said first entangling member, said composite web in said first stage being impacted with energy of approximately 0.7 hp-hr/lb;

(c) supporting said composite web on a second entangling member having a symmetrical pattern of fluid pervious void areas, said symmetrical pattern of said second entangling member being different from that of said first entangling member; and (d) traversing the bottom side of said composite web with spaced columnar fluid jets at pressures within the range of 400 to 2000 psi for sufficient duration to effect a second stage randomization and entanglement of the nonwoven fabric, said composite web in said second entangling stage being impacted with energy of approximately 1.2 hp-hr/lb, the fabric having a resulting structure determined by the coaction of the first and second randomization and entanglement on said first and second entangling members.

3. The method of claim 2, comprising the further steps of extracting fluid from the fabric following said first and second entangling stages, and saturating the fabric with a resin binder coating.

4. The method of claim 3, wherein said composite web includes 70% 1.5 inch denier staple rayon, and 30% polyester, and has a basis weight of approximately 60 gsy.

5. The method of claim 4, wherein said carded and randomized web components each comprise 50% of said composite web, the fabric has a basis weight of approximately 60 gsy, uniform cohesive MD and CD grab tensile strengths of approximately 15 lbs/inch and 10 lbs/inch, respectively, an MD/CD fiber ratio of approximately 2.5:1, and void areas which occupy approximately 36% of the fabric.

* * * * *